United States Patent [19]

Wolz

[11] 3,961,447

[45] June 8, 1976

[54] PRISON DOOR LOCKING MECHANISM

[75] Inventor: Francis T. Wolz, Joliet, Ill.

[73] Assignee: Folger Adam Co., Joliet, Ill.

[22] Filed: June 13, 1975

[21] Appl. No.: 586,796

[52] U.S. Cl. ..... 49/362; 49/449; 49/15

[51] Int. Cl.[2] ..... E05F 11/34

[58] Field of Search ..... 49/15–18, 49/362, 349

[56] References Cited

UNITED STATES PATENTS

| | | | |
|---|---|---|---|
| 464,947 | 12/1891 | Sparks et al. | 49/17 |
| 1,739,897 | 12/1929 | Garber | 49/17 |
| 1,997,175 | 4/1935 | Gussack | 49/362 |
| 3,271,901 | 9/1966 | Bednar | 49/17 |
| 3,343,302 | 9/1967 | Browning et al. | 49/362 X |
| 3,426,478 | 2/1969 | Sturges et al. | 49/16 |

*Primary Examiner*—Kenneth Downey
*Attorney, Agent, or Firm*—McCaleb, Lucas & Brugman

[57] ABSTRACT

A prison door locking mechanism particularly suitable for use with each of a pair of sliding prison doors laterally movable into stacking or overlapping position. The door locking mechanism includes a novel pivotally mounted locking dog having a latch engageable with a door-suspending carriage to lockably restrain carriage movement. The locking dog includes a projecting arm engaged by a rack bar coupled to the carriage to insure deadlock rotation of the locking dog to its locking position.

6 Claims, 5 Drawing Figures

PRISON DOOR LOCKING MECHANISM

BACKGROUND OF THE INVENTION

1. Field of the Invention

This invention relates in general to locking mechanisms and, more particularly, to those particularly suitable for use with sliding prison doors.

2. Description of the Prior Art

Known sliding prison door operating and locking mechanisms, typified by devices disclosed in U.S. Pat. Nos. 3,271,901, 3,426,478, and 3,564,772, are of complex design, and generally utilize vertical locking columns to provide secure and tamper-proof locking of sliding doors. Particularly because of their complexity, known prison door operating and locking mechanisms are not readily adaptable for use with stacking or overlapping prison doors.

SUMMARY OF THE INVENTION

The present invention provides a simple and inexpensive solution to this problem, and provides a novel door locking mechanism operable to insure deadlock engagement of a novel locking dog with a door-suspending carriage, obviating the need for complex locking systems, including those having locking columns. The present invention thereby provides a locking system which affords necessary security and tamper-free operation at a minimum cost.

The door locking mechanism of the present invention is adaptable for use with a prison door laterally movable across an opening defined by a doorway frame. The door locking mechanism generally comprises: a door-suspending carriage slidingly movable above the frame, the carriage having a transverse end latch plate; a rack bar; coupling means, preferably comprising a pressure pad assembly, for connecting the rack bar to the carriage and for providing limited relative movement therebetween; reversible rack bar drive means for moving the door between open and closed positions; a cam carried by the rack bar; a novel locking dog pivotally mounted to the doorway frame and having cam follower means for effecting pivotal locking dog movement between inner latched and outer unlatched positions in response to movement of the rack bar, the locking dog having a latch engageable with the latch plate when the locking dog is in its inner position to lockably restrain carriage movement; spring means for urging the locking dog into its inner position; and bumper means for blocking movement of the carriage beyond a predetermined position adjacent the locking dog and corresponding to door closure; the locking dog having a protruding arm engaged by the rack bar upon bar movement relative to the carriage when the carriage is in its door-closure position to insure deadlock rotation of the locking dog to its inner position.

DESCRIPTION OF THE PREFERRED EMBODIMENT

Figure 1:
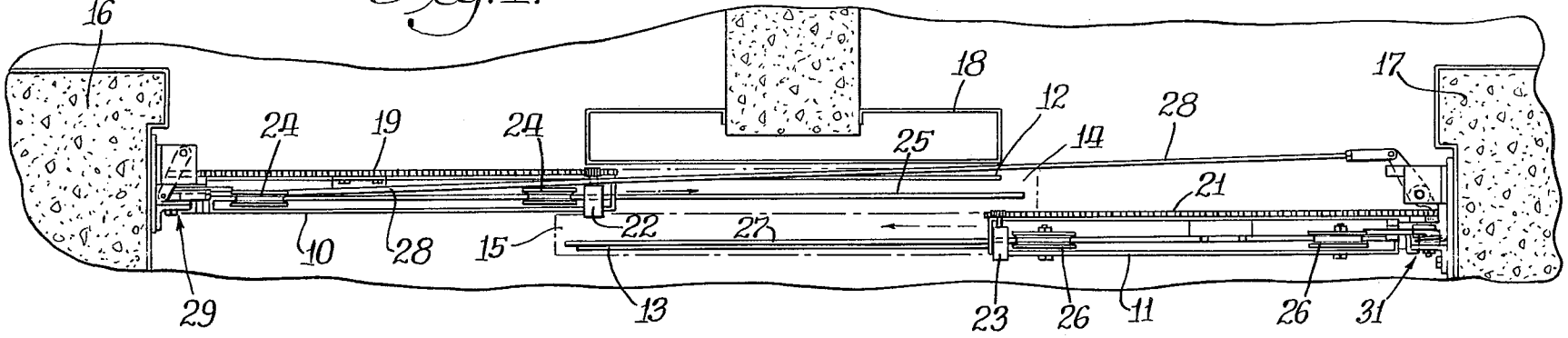
FIG. 1 is a top plan view, with parts broken away and parts in section, of a pair of overlapping prison doors embodying the features of the present invention.

With reference to FIG. 1, a pair of parallel known door-suspending carriages 10, 11 are provided for supporting associated doors below (not shown) by conventional hanger means extending through a pair of associated slots 12, 13 in doorway frames 14, 15. The door-suspending carriages 10, 11 are operable to slidingly move their respective doors from substantially coplanar door openings adjacent respective cell block wall portions 16, 17 into back-to-back overlapping or stacking relationship opposite a central support column 18, the overlapping arrangement providing well-known advantages of economy and space.

A pair of gear rack bars 19, 21 are independently driven by reversible drive means comprising electric motors 22, 23 having pinions in meshing relation with their associated rack bars to effect lateral sliding movement of their associated carriages 10, 11 by means of a first pair of grooved wheels 24 riding on track 25, and a second pair of grooved wheels 26 riding on track 27, respectively. A common release bar 28 is provided for unlocking both doors simultaneously in a manner to be described. A pair of identical left and right locking mechanisms, generally illustrated by reference numerals 29 and 31, are provided for securely engaging associated door-suspending carriages 10, 11 to lockably restrain movement thereof. Since the locking mechanisms 29 and 31 are identical, only the details of the right-hand mechanism 31 will be described.

Figure 2:
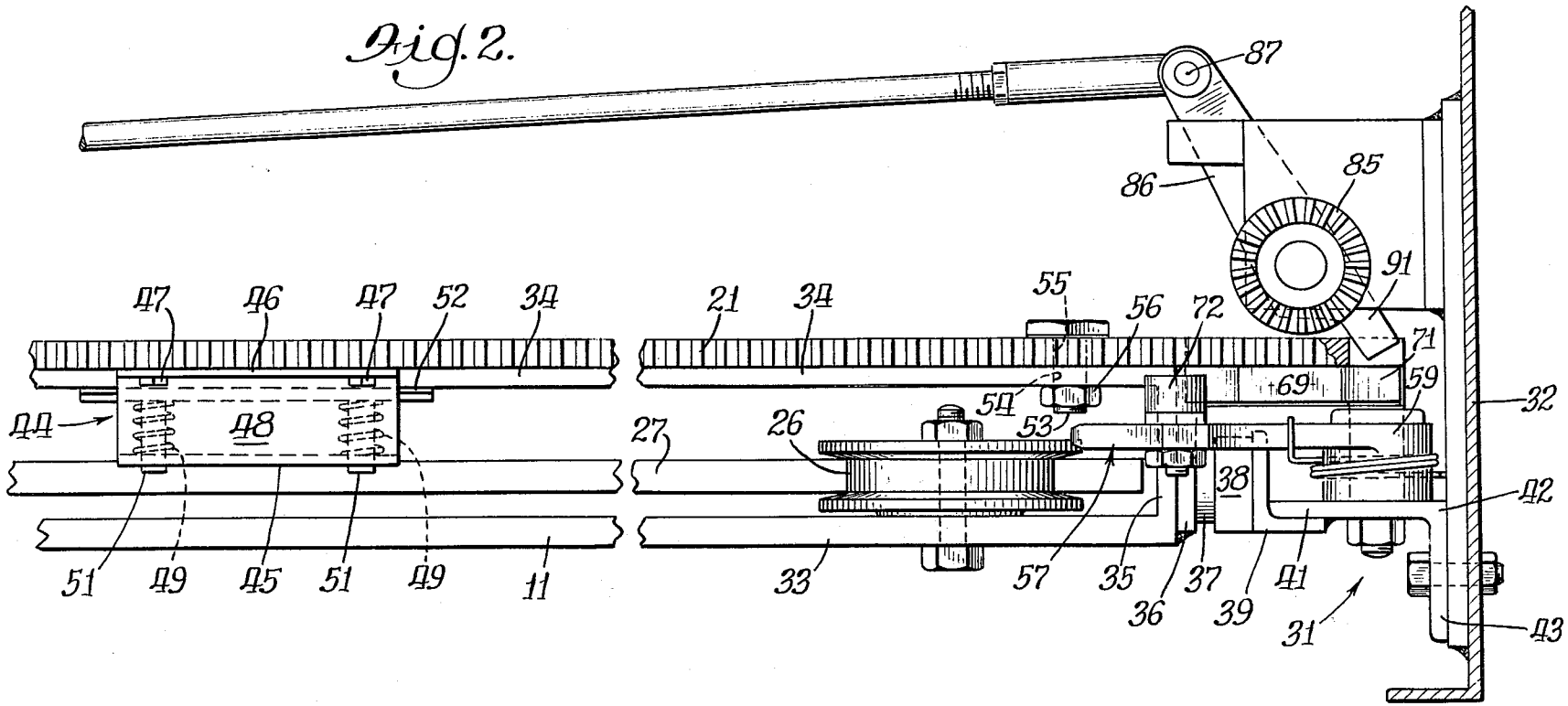
FIG. 2 is a top plan view, with parts broken away and parts in section, of a portion of the right-hand door shown in FIG. 1.
Figure 3:
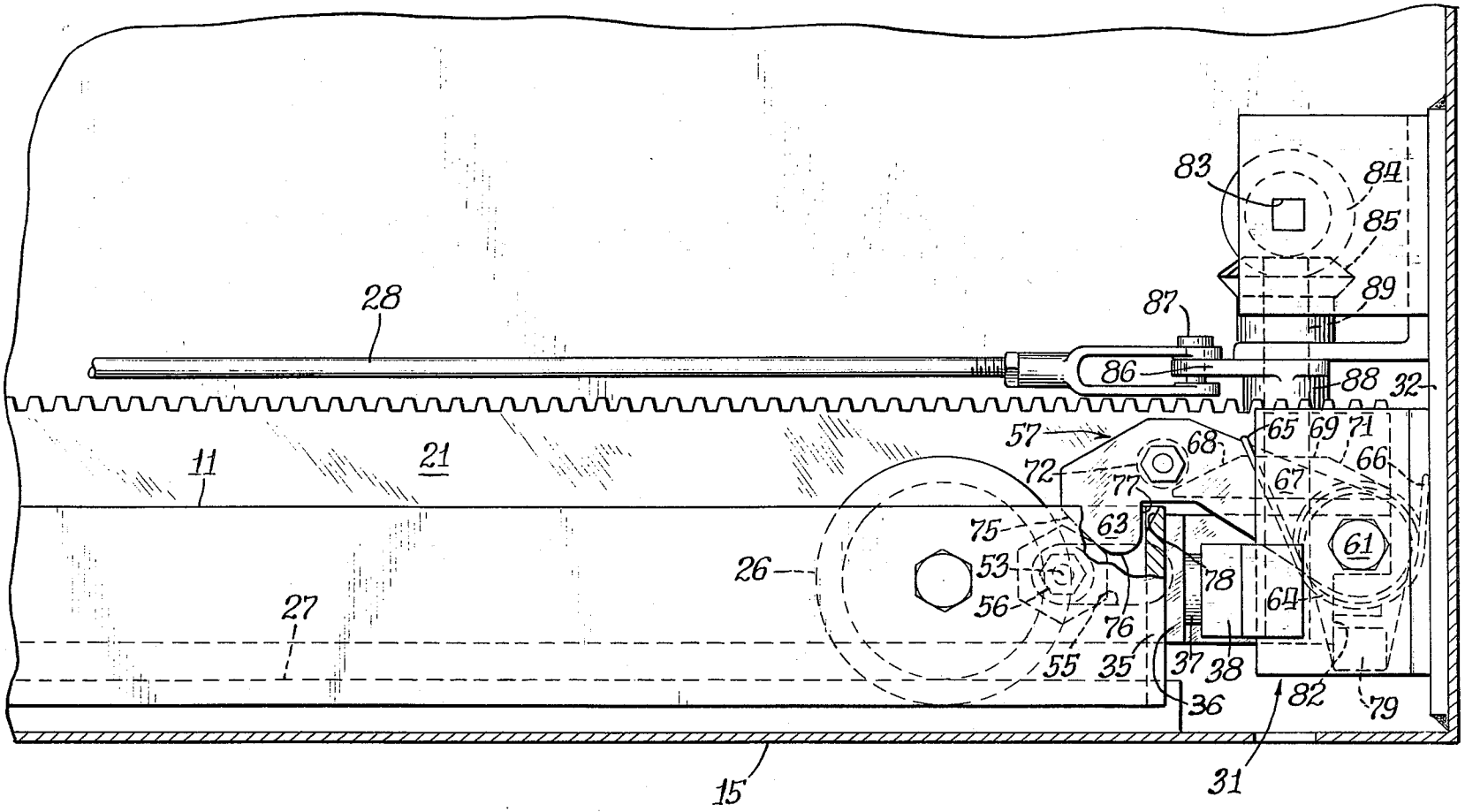
FIG. 3 is a front elevational view, with parts broken away and parts in section, of the locking mechanism shown in FIG. 2.

As best seen in FIGS. 2 and 3, the doorway frame comprises a vertical support plate 32 to which can be connected a known horizontal protective cover (not shown) to define a housing for the right-hand door operating mechanism 31. Carriage 11 comprises a pair of parallel front and rear rectangular plates or bars 33, 34 (FIG. 2) joined at their right-hand end by an integral transverse or perpendicular end latch plate 35. A bumper plate 36 (FIGS. 2 and 3) is secured to latch plate 35 to engage a rubber bumper 37 (FIGS. 4 and 5) mounted within a housing 38 secured to as L-shaped bumper bracket 39 in turn connected to a flange 41 (FIG. 4) of a locking dog bracket 42 having another flange 43 suitably bolted to the frame member 32. The bumper 37 restrains rightward movement of the carriage 11 to a predetermined position which corresponds to full closure of the door suspended by that carriage.

With particular reference to FIG. 2, lost motion coupling means are provided for connecting gear rack bar 21 to carriage 11 and for providing limited relative movement therebetween. A coupling pad assembly 44 comprises an L-shaped bracket 45 having a vertical portion 46 thereof rigidly secured to rack 21 by means of bolts 47. Attached to a horizontal portion 48 of bracket 45 are a pair of coil springs 49 (below portion 48) guided by a pair of associated pins 51 to urge a vertically planar frictional pressure pad 52 into frictional engagement with bar 34 of carriage 11. When the rack bar 21 is moved laterally by motor 23, the pressure pad assembly 44 attempts to provide corresponding motion of the carriage 11. A bolt 53 (FIGS. 2 and 3) is situated within a hole 54 in bar 34 and slidably disposed within a horizontal slot 55 in rack bar 21, a retaining nut 56 being threaded onto bolt 53. Bolt 53 is operable to limit the relative movement of the rack bar 21 with respect to carriage 11. It will be appreciated that when the rack bar 21 and carriage 11 are moved rightward, upon engagement of the end plate 36 with bumper 37, the motion of the carriage 11 will be terminated, but the rack bar 21 will be moved a short distance rightward, equal to the width of slot 55, for a purpose to be described.

Figure 4:
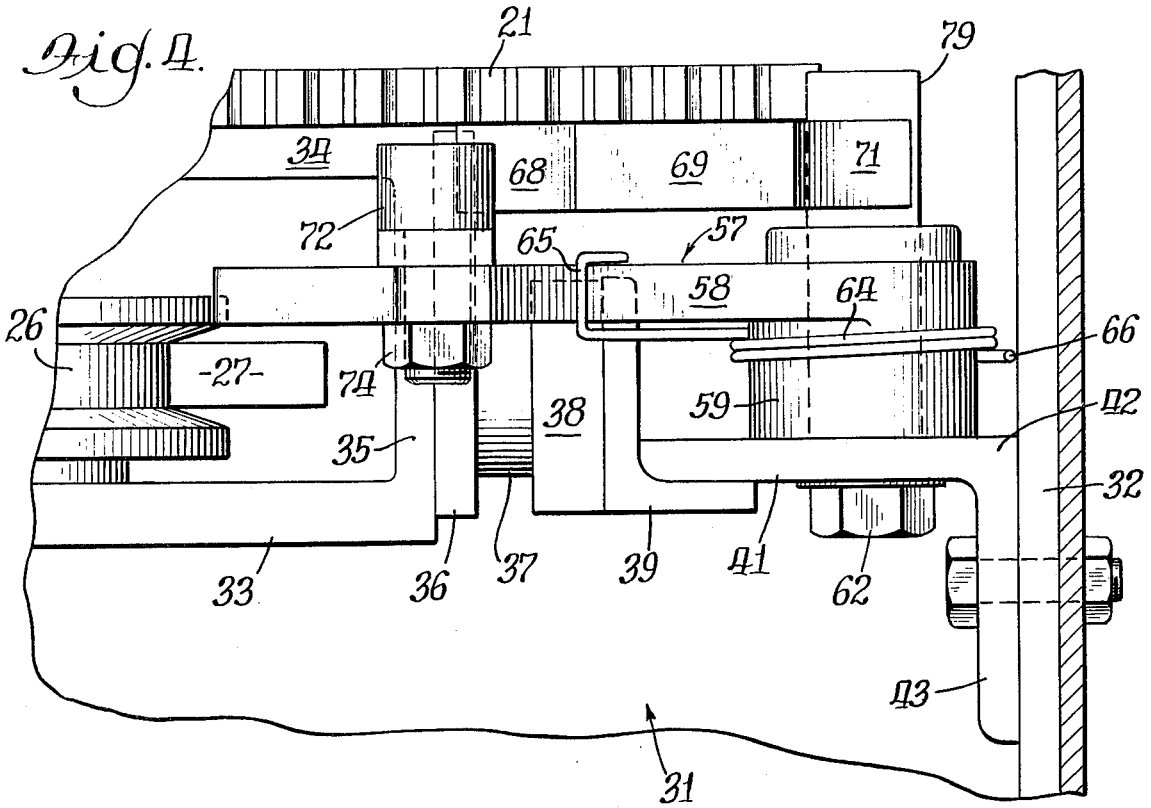
FIG. 4 is a top plan view, with parts broken away and parts in section, showing the details of the right-hand locking dog.
Figure 5:
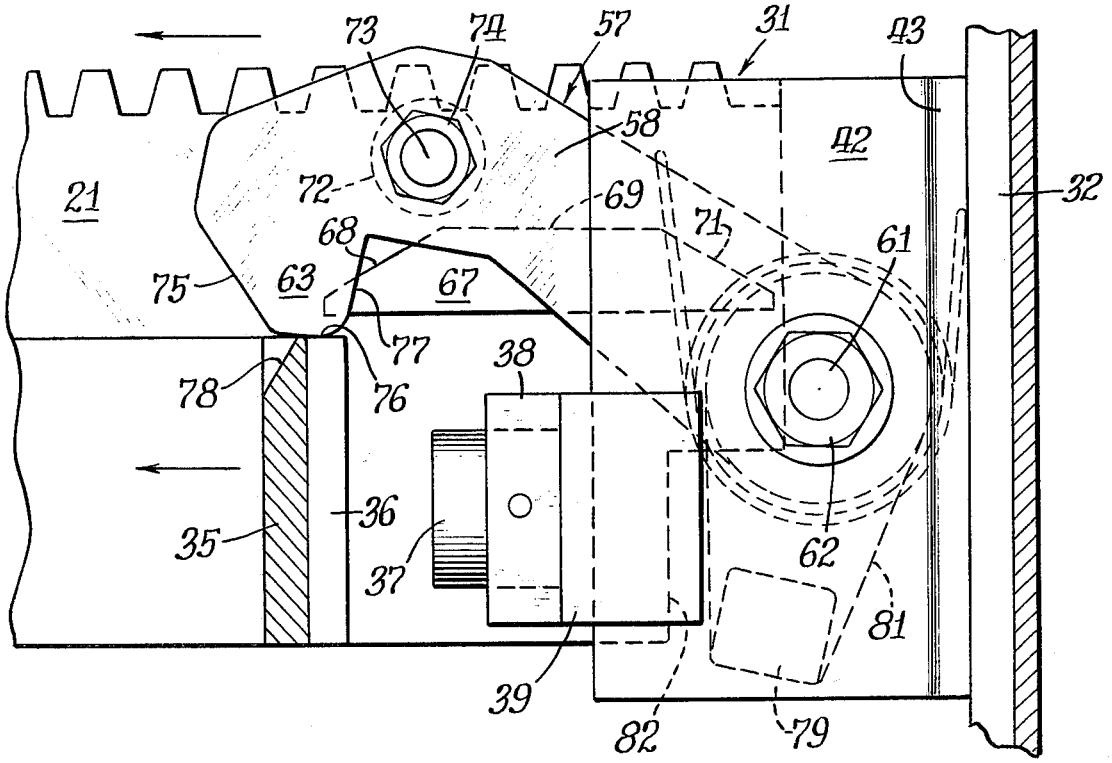
FIG. 5 is a front elevational view, with parts broken away and parts in section, illustrating operation of the novel locking dog of the present invention.

As best seen in FIGS. 3, 4 and 5, the prison door locking mechanism of the present invention includes a locking dog, generally illustrated by reference numeral 57, comprising an elongated body portion 58 integrally formed with a generally circular sleeve 59 (FIGS. 2 and 4) in turn suitably journaled to effect pivotal movement of body portion 58 in a vertical plane between an inner lower locking position (shown in FIG. 3) and an upper or outer position (shown in FIG. 5) about a pivot 61 (FIGS. 3 and 5) in turn secured to flange 41 of L-shaped bracket 42 by means of a nut 62 (FIG. 4). The outer end of locking dog 57 comprises a downwardly depending hook or latch portion 63 (FIG. 3) engageable with the latch plate 35 when the locking dog 57 is in its inner lower locking position to lockably restrain leftward movement of the carriage 11 and the door suspended thereby. A wire spring 64 (FIGS. 3 and 4) has ends 65, 66 for respective engagement with the body portion 58 of the locking dog 57 and the vertical portion 32 of the doorway frame, in order to urge the locking dog into its lower position.

As best seen in FIGS. 3 and 5, suitably secured to rack bar 21 is a trapezoidal-shaped cam 67 having a left-hand sloping face 68, a top horizontal face 69 and a right-hand sloping face 71. Cam 67 cooperates with cam follower means 72 (FIGS. 4 and 5) preferably comprising a roller suitably journaled for rotation about a pivot 73 secured to the body portion 58 of locking dog 57 by means of a nut 74 to effect pivotal locking dog movement between its lower and upper positions in response to movement of the rack bar 21.

It will be seen that as carriage 11 and rack bar 21 move simultaneously (through the agency of the previously described coupling means) rightward, as viewed in FIGS. 3 and 5, engagement between roller 72 and the right-hand face 71 of the cam 67 will cause the locking dog 57 to pivot upwardly, enabling a left cam face 75 of latch 63 to engage the upper right-hand corner of latch plate 35 to effect further upward movement of locking dog 57. Continued rightward movement will cause a lower flat portion 76 of latch 63 to engage the top surface of latch plate 35 until an inner surface 77 of latch 63 engages an inner sloping surface 78 in the end latch plate 35, thereby enabling the locking dog 57 to rotate downwardly through the agency of spring 64 to its FIG. 3 position. In its inner lower locked position illustrated in FIG. 3, the flat surface 77 of the latch 63 engages the left-hand surface of latch plate 35, with the result that movement of the door carriage 11 leftward will be prevented.

As best seen in FIGS. 4 and 5, locking dog 57 has a rearwardly protruding arm 79 secured to the sleeve 59 by means of a downwardly depending lever 81 (FIG. 5). The right-hand surface of bar 21 has a notched surface 82 (FIGS. 3 and 5) engageable with the arm 79 upon rightward relative movement between rack bar 21 and carriage 11, when restrained by bumper 37, in order to move arm 79 rightward, thereby forcing locking dog 57 to pivot into its FIG. 3 locked position should spring 64 fail to operate. Thus, deadlock rotation of the locking door 57 to its lower locked position is insured.

It will be appreciated that leftward movement of rack bar 21, normally by means of motor 23, will be necessary to initiate unlocking of locking dog 57. With reference to FIG. 3, initial leftward movement of the rack bar 21 will cause the roller 72 to engage the left-hand surface 68 of cam 67 to effect clockwise rotation of the locking dog 57, causing latch 63 to move upwardly. Further leftward movement of the rack bar 21 will first cause surface 77 of latch 63 to engage the sloping surface 78, and then cause the lower surface 76 of the latch 63 to ride on the upper horizontal surface of the end latch plate 35 (as shown in FIG. 3). Thereafter, additional leftward movement of the rack bar 21 will allow the locking dog 57 to drop out of engagement with the latch plate 35. The rack bar 21 will move relative to the carriage 11 until the latch 63 of the locking dog 57 releases the latch plate 35, at which point the pressure pad assembly 44 will effect simultaneous movement of the rack bar 21 and the carriage 11.

Should failure of motor 23 occur, known means are provided for effecting unlocking of the locking dog 57 to enable manual carriage movement leftward. As best seen in FIG. 3, a known socket 83 is provided within a bevel gear 84 suitably journaled for rotation about a horizontal axis and engageable with a gear 85 (FIGS. 2 and 3) in turn connected to an arm 86 pivotally connected to release bar 28 at pivot 87 through suitable linkage. Gear 85 is connected to a lower sleeve 88 suitably journaled for rotation about an inner shaft 89 (FIG. 3) in a known manner and having a lower arm 91 (FIGS. 2 and 3) engageable with notch 82 in bar 21. It will be apparent that rotation of sleeve 88 will cause the release bar 28 to move rightward from its FIG. 2 position and cause arm 91 to move leftward to engage notch 82 of the bar 21, thereby resulting in initial leftward movement of the bar to effect rotation of the locking dog 57 from its locked position. The release bar 28 also serves to simultaneously release the left-hand locking mechanism 29, thereby unlocking both doors. Once the locking dog in each of the locking mechanisms 29 and 31 are released, the doors can be opened manually.

It is thought that the invention and many of its attendant advantages will be understood from the foregoing description, and it is apparent that various changes may be made in the form, construction and arrangement of its component parts without departing from the spirit and scope of the invention or sacrificing all its material advantages, the form described being mereby a preferred embodiment thereof.

The embodiments of the invention in which an exclusive property or privilege is claimed are defined as follows:

1. For use with a prison door laterally movable across an opening defined by a doorway frame, a door locking mechanism comprising: a door-suspending carriage slidingly and laterally movable about the frame, said carriage having a transverse end latch plate; a rack bar; coupling means for connecting said rack bar to said carriage and for providing limited relative movement therebetween; reversible rack bar drive means for moving said door-suspending carriage between open and closed positions; a cam carried by said rack bar; a locking dog pivotally mounted to the frame and having cam follower means for effecting pivotal locking dog movement between inner and outer positions in response to movement of said rack bar, said locking dog having a latch engageable with said latch plate when said dog is in said inner position to lockably restrain carriage movement; spring means for urging said locking dog into said inner position; and bumper means for blocking movement of said carriage beyond a predetermined position adjacent said locking dog and corresponding to door closure; said locking dog having a protruding arm engaged by said rack bar upon movement thereof toward said arm and relative to said carriage when the latter is in said predetermined position to insure deadlock rotation of said locking dog to said inner position.

2. The door locking mechanism of claim 1, wherein said locking dog is pivoted for movement between lower and upper positions and said latch plate comprises a vertical plate engageable with said latch when said locking dog is in said lower position.

3. The door locking mechanism of claim 1, a horizontal slot within said rack bar, and wherein said coupling means comprises a bolt through said carriage and slidably disposed within said slot, said coupling means further comprising a pressure pad assembly including a bracket secured to said rack bar, a pressure pad and spring means connected to said bracket for urging said pad into frictional engagement with said carriage.

4. The door locking mechanism of claim 1, wherein said spring means comprises a wire spring having ends thereof engaging the frame and said locking dog.

5. The door locking mechanism of claim 1, wherein said cam follower comprises a roller.

6. For use with a pair of prison doors laterally movable across substantially coplanar openings defined by doorway frames to an overlapped position, a door locking mechanism for each of the doors comprising: a door-suspending carriage slidingly and laterally movable above the frame, said carriage having a transverse end latch plate; a rack bar; coupling means for connecting said rack bar to said carriage and for providing limited relative movement therebetween; reversible rack bar drive means for moving the door between open and closed positions; a cam carried by said rack bar; a locking dog pivotally mounted to the frame and having cam follower means for effecting pivotal locking dog movement between inner and outer positions in response to movement of said rack bar, said locking dog having a latch engageable with said latch plate when said dog is in said inner position to lockably restrain carriage movement; spring means for urging said locking dog into said inner position; and bumper means for blocking movement of said carriage beyond a predetermined position adjacent said locking dog and corresponding to door closure; said locking dog having a protruding arm engaged by said rack bar upon movement thereof toward said arm and relative to said carriage when the latter is in said predetermined position, to insure deadlock rotation of said locking dog to said inner position; and manually operable common release bar means connected to each said rack bar for effecting simultaneous rack bar movement and resultant pivotal movement of each said locking dog to its outer position for simultaneously unlocking each door-suspending carriage.

* * * * *

UNITED STATES PATENT OFFICE
CERTIFICATE OF CORRECTION

ATENT NO. : 3,961,447

)ATED : June 8, 1976

NVENTOR(S) : Francis T. Wolz

It is certified that error appears in the above–identified patent and that said Letters Patent ıre hereby corrected as shown below:

Col. 2, line 48, "as" should be --an--.

Col. 4, line 64, "about" should be --above--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*